United States Patent [19]

Takada

[11] Patent Number: 4,852,508

[45] Date of Patent: Aug. 1, 1989

[54] UNDERWATER WINDOW FOR VESSELS

[76] Inventor: Shigeyuki Takada, 1-22-5, Kakinokizaka, Meguro-ku, Tokyo, Japan

[21] Appl. No.: 229,758

[22] Filed: Aug. 9, 1988

Related U.S. Application Data

[63] Continuation-in-part of Ser. No. 51,528, May 19, 1987, abandoned.

[30] Foreign Application Priority Data

Jun. 4, 1986 [JP] Japan ..... 61-129430

[51] Int. Cl.[4] ..... B63B 3/13; B63B 19/00

[52] U.S. Cl. ..... 114/177; 114/66; 114/313; 350/319; 354/64

[58] Field of Search ..... 114/177, 66, 313; 350/319, 418; 52/80, 200; 354/64

[56] References Cited

U.S. PATENT DOCUMENTS

| | | | |
|---|---|---|---|
| 2,256,133 | 9/1941 | Barnes | 354/64 |
| 3,611,970 | 10/1971 | Hagan | 114/177 |
| 3,733,981 | 5/1973 | Buchanan | 350/319 |
| 3,750,547 | 8/1973 | Walthier et al. | 354/64 |
| 3,788,730 | 1/1974 | Greenleaf | 350/418 |

FOREIGN PATENT DOCUMENTS

| | | | |
|---|---|---|---|
| 1497555 | 10/1967 | France | 114/66 |
| 685548 | 9/1979 | U.S.S.R. | 114/177 |
| 1068342 | 1/1984 | U.S.S.R. | 114/66 |

*Primary Examiner*—Sherman D. Basinger
*Assistant Examiner*—Thomas J. Brahan
*Attorney, Agent, or Firm*—Fleit, Jacobson, Cohn, Price, Holman & Stern

[57] ABSTRACT

An underwater window for vessels which is provided to cover an opening made on the hull has a first transparent plate curved to form a convex surface bulging toward the outside of hull outwardly from the hull. One or two additional transparent plates are provided to cover the concave space which is formed on the cabin side by the first curved plate. The space formed by the curved plate and the additional plate, or plates, is filled with a liquid. The liquid contains distilled water and an algaecide, such as $CuSO_4$ and has its pH adjusted to with the range of 7.0–7.6.

3 Claims, 3 Drawing Sheets

UNDERWATER WINDOW FOR VESSELS

This is a continuation-in-part of application Ser. No. 07/051,528, filed May 19, 1988 which is now abandoned.

SUMMARY OF THE INVENTION

The present invention relates to an improvement in windows for vessels provided underwater. The window according to the present invention comprises a spherical surface bulging outside which is made of a transparent plate of reinforced glass, reinforced plastics, etc. and a flat or substantially flat transparent plate to be attached to cover a concaved space formed on the cabin side by the transparent spherical surface bulging toward the outside, said space formed by these two transparent surface being filled with liquid.

As the underwater window for vessels according to the present invention is structured in such a way that the water pressure acting on the windowpane is borne by said transparent spherical surface plate, it is not particularly necessary to increase the thickness of the plate to make it particularly pressure-resistant. Also since the space created by these two transparent plates is filled with liquid and the transparent plate provided on the cabin side is made flat or substantially flat, the deeply concaved surface will not constitute a direct boundary between the water and the cabin in order that the objects in the water can be observed substantially in their life size.

DETAILED DESCRIPTION OF THE INVENTION

(Background of the Invention)

Generally, underwater windows for vessels are required to have a high mechanical strength and high water-tightness at the portions where they are mounted onto the hull of the vessel because of extremely high water pressures to which these windows are subjected.

Therefore, it has been considered sufficient for windows of an ordinary vessel to have a degree of transparency which allows a peek in the water, with a generally very narrow field of view, and the objects observed from these windows looking deformed.

For windows of vessels for underwater investigation or observation, improvements have been made to the window to secure as wider visual field as possible and with views without deformation.

In order to secure a wider visual field and a view which is in life size and not deformed, it was necessary to increase the diameter of the window facing the water and to make the transparent plate to be placed in the window to be as flat and uniform as possible in thickness.

However, if one was to place a transparent plate of reinforced glass or plastics in the window frame having a greater diameter, the windowpane was very likely to be destroyed by the high water pressure because of the structurally low resistance to water pressure.

It was, therefore, necessary to increase the thickness of the transparent plate in proportion to the diameter of the underwater window frame if such a transparent flat plate was to be used as the windowpane for the underwater window.

Forming of such a thick glass or plastic plate is usually difficult and sophisticated technology is required to provide a uniform and high mechanical strength and appropriate optical refractive index, involving an inhibitively high cost in manufacturing the plate itself. Further defect was that the thicker the windowpane, the darker the visual field naturally became.

Attempts were therefore made to curve the glass or plastic plate of a uniform thickness to form a spherical surface, and the plate was placed in the window frame in such a way that the bulging surface faced the water.

Because of the spherical surface, the plate according to this method has a higher mechanical resistance toward the water pressure and allows the use of a frame with a greater diameter and a thinner plate.

The spherical surface of the plate with a substantially uniform thickness will in turn form a concaved space on the cabin side. When the window is submerged in the water, this transparent plate with a uniform thickness would divide the cabin from the water with a concaved boundary surface, resulting in a use of a concave lens. Thus, when a viewer looks out of the window into the water, the objects in the water appear far smaller than their life size and deformed at the periphery of the window.

On the other hand, it is conceivable to form the transparent plate in the frame as a convex lens so that the underwater objects are viewed in enlargement. In this case, the mechanical characteristics of the plate become advantageously improved.

However, manufacture of such a transparent plate as a convex lens entails difficulty both in technique and cost of parts, and the plate thus obtained is also defective in that the views appear more deformed in areas farther away from the center of the window.

Because of the defects of the prior art window, the underwater windows currently used for vessels are usually made as small as possible in diameter and the windowpane to be placed is made of a flat and transparent plate of a uniform thickness.

(Objects of the Invention)

The primary object of the present invention is to provide an underwater window for vessels which comprises, in place of the conventional single structure of a glass windowpane, a reinforced transparent plate of a uniform thickness having a semi-spherical surface which withstands the water pressure and a flat or substantially flat and transparent plate which covers a concaved space formed on the cabin side by said semi-spherical transparent plate, said space between the two transparent plates being filled with liquid to prevent a concave boundary surface to be formed between the cabin and the water.

Another object of the present invention is to allow a viewer to see the objects in life size when viewing out of the window from the cabin.

Still another object of the present invention is to use a transparent plate which is available at a relatively low cost instead of a thick plate or a transparent plate of convex lens despite a greater diameter of the window to give a wider visual field for viewing.

Still another object of the present invention is to use a transparent plate to be placed in the window frame which is uniform but relatively smaller in thickness, so that the objects to be viewed would not appear markedly deformed in areas farther away from the center of the window.

(Construction of the Invention)

The underwater windows for vessels according to the present invention can be better understood from the accompanying drawings, in which FIG. 1 shows a vessel with the windows according to the invention, and more particularly it is a side view of a submarine.

Figure 1:
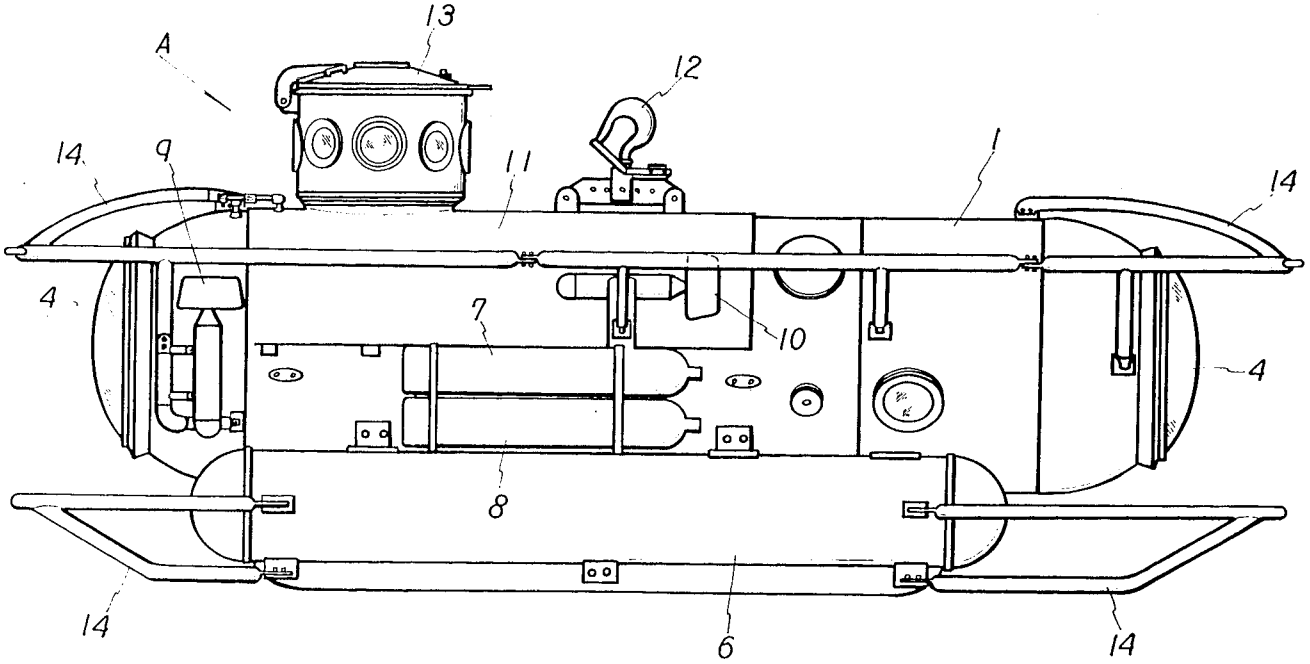
Figure 2:
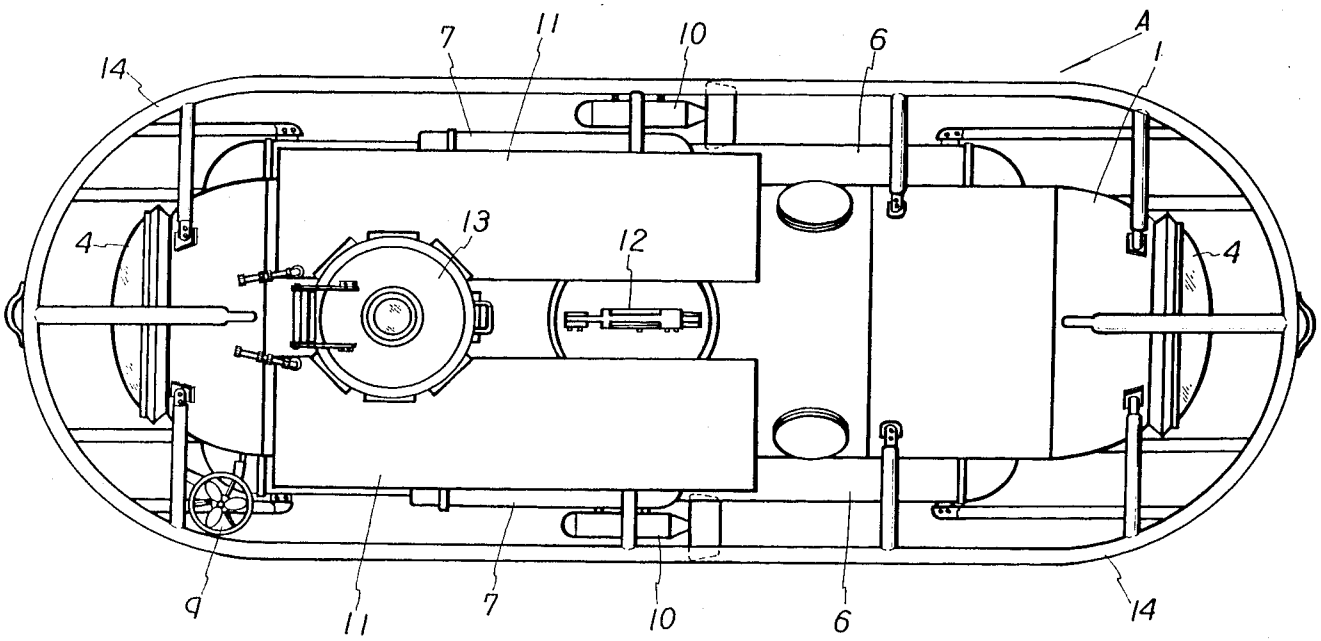
FIG. 2 is a top view of the submarine.
Figure 3:
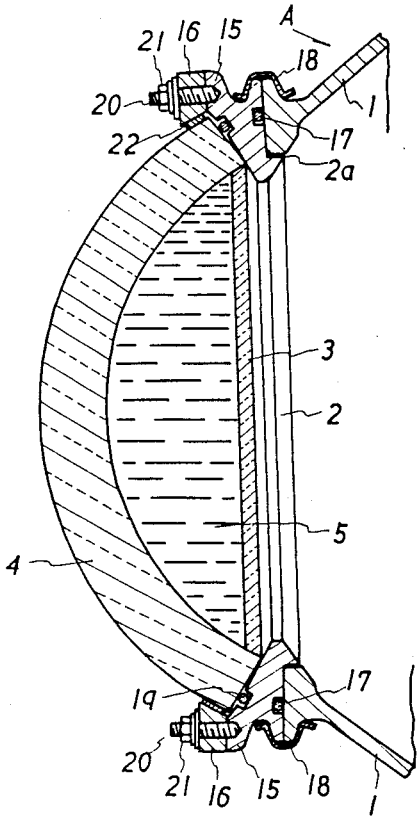
FIG. 3 shows a typical structure of the window according to the present invention wherein a sectional view of a portion of the submarine is shown.

As shown in FIG. 3, the underwater window for vessels according to the present invention is constructed by an opening 2 in a hull 1, to which a flat or substantially flat and transparent plate 3 and a spherical transparent plate 4 are attached in a manner to cover said opening.

The transparent plate 4 having a substantially uniform thickness is curved to bulge toward the water side. The water pressure is borne by this plate 4.

The transparent plate 3 also having a substantially uniform thickness is made flat or substsantially flat so as to cover the concaved space on the cabin side formed by said transparent plate 4, said space to be filled and sealed with liquid 5.

The space formed by the transparent plates 3 and 4 is filled with the liquid 5 of substantially the same nature as the water outside the vessel.

It is noted that the transparent plate 3 may also be slightly bulged either toward the water or the cabin. When the plate 3 curves toward the cabin, the objects in the water appear larger than life size whereas when they curve toward the water, the objects being observed appear smaller.

(Actions and Effects)

As the underwater window for vessels according to the present invention receives the water pressure via the spherical transparent plate 4 and as the concaved space on the cabin side formed by the plate 4 is covered by the transparent plate 3 and is filled with the liquid 5, the boundary between the cabin and the water can be made substantially planar without curvature. As a result, when a viewer looks out of the window from the cabin, objects can be seen substantially in their life size (despite slight refraction due to the presence of the transparent plates 3 and 4) without deformation in the peripheral areas.

Moreover, as the water pressure acts on the spherical transparent plate 4, sufficient pressure resistance can be readily obtained even if the diameter of the window is made greater, offering a wider vision.

The thickness of the plates 3 and 4 relative to the window diameter need not be extremely great, enabling the manufacture of these plates 3 and 4 at a relatively low cost.

Further, since the transparent plates 3 and 4 are thinner as a whole, the window becomes more transparent, offering a clearer view of the objects being observed.

(Embodiments)

Typical embodiments of the present invention will now be described referring to a submarine having a larger window.

In one embodiment, reference letter A denotes a submarine which comprises a hull 1, opening 2 for underwater observation each provided on both ends of the hull 1, a battery 6 as the power source, a compressed air bomb 7 for feeding a ballast tank 11 to be described below, a bomb 8 to supply oxygen into the hull 1, a screw 9 for adjusting the inclination of the hull 1 in the advance direction of the submarine, a screw 10 for turning and propelling the hull 1 in the lateral direction, and a ballast tank 11 for adjusting the depth. Reference number 12 denotes a hook for slinging the hull 1, 13 a hatch and 14 guards at both ends and at the top and the bottom.

A collar **1*a* is projected on the opening 2 of the hull 1 and extends outwardly to constitute a flat attaching surface 1b for attaching a fixing means 15 for the window frame. The fixing means 15 for the window frame to be attached to said attaching surface has, on its outside, a collar 15*a* to contact with said collar 1*a* and a stepped portion 15*b* on the inside to be engaged with an inner periphery 2*a* of the opening 2. An outward collar 15*d* is provided at a position opposing the collar 15*a* via a peripheral groove 15*c* to receive a retaining means 16. The portion between the collar 15*d* and the stepped portion 15*b* is sloped 15*e* which gradually extends toward the outside. The peripheral side of the transparent plate 4 abuts the slope 15*e***.

In the actual construction of a window, the fixing means for the window frame 15 is fixed to the collar **1*a* of the hull 1 via an O ring 17 by engaging the steppd portion 15*b* of the fixing means 15 with the inner periphery 2*a* of the opening 2 by means of a coupling 18. Then, an O ring 19 is inserted in a groove 15*f* provided on the slope 15*e* of the fixing means 15 to secure the transparent plate 4 on said slope 15*e* by means of the retaining means 16**.

The retaining means 16 is fixed on the collar **15*d* of the fixing means 15 by means of a bolt 20 and a nut 21. The nut 21** is tightly screwed via a spring washer and a flat washer.

The inside of the retaining means 16 is formed as a tapered surface **16*a* substantially corresponding to the curvature of the transparent plate 4. A gasket 22 is interposed between the tapered surface 16*a* and the transparent plate 4**.

The transparent plate 4 thus attached has a spherical surface bulging from the opening 2 of the hull 1 toward the outside. The plate is substantially uniform in thickness.

The transparent plate 3 is fixed to the plate 4 in a manner to cover the concaved space which the transparent plate 4 forms on the cabin side.

It is noted that the transparent plate 3 may be a flat plate to create a flat surface with respect to the opening 2, or a slightly curved plate bulging from the opening 2 toward the plate 4, or a slightly curved plate bulging from the opening toward the cabin. In case the plate 3 bulges toward the cabin, the objects being observed outside the vessel appear slightly larger than their life size. In case the plate 3 bulges toward the outside the vessel, the objects appear slightly smaller than the life size.

The transparent plates 3 and 4 may be directly attached to each other, or they may be connected using such means as the fixing means 15 for the window frame.

The space formed by thus assembled transparent plates 3 and 4 is filled with the liquid 5 having a similar refractive index as that of the fresh or sea water surrounding the vessel.

Figure 4:
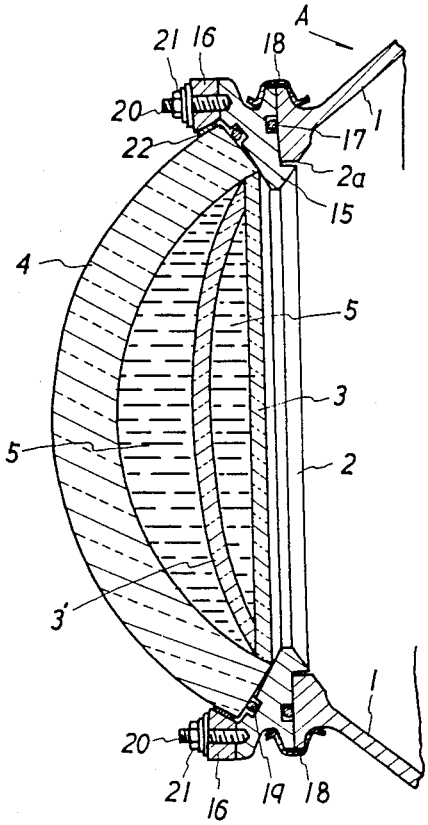
FIG. 4 is a sectional view of another embodiment of the window according to the present invention.
Figure 5:
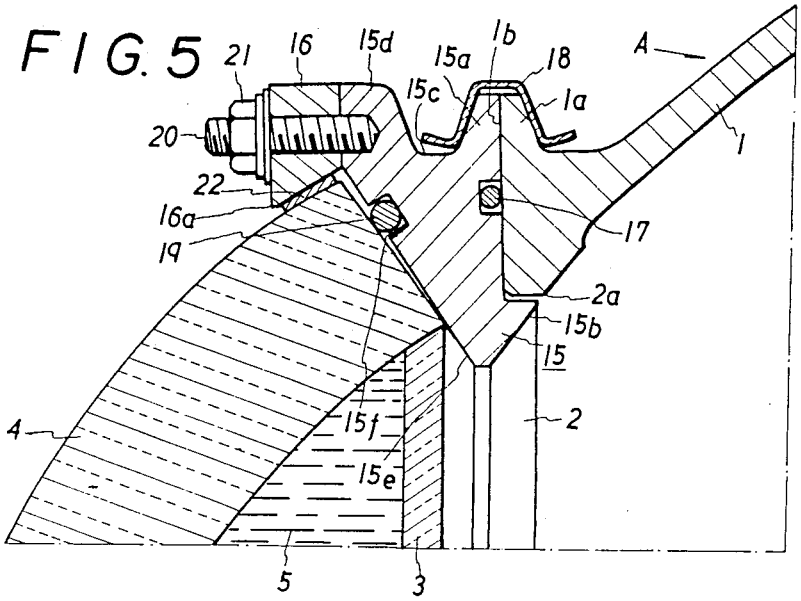
FIG. 5 shows an enlarged cross section of the essential parts of FIG. 3.

A second embodiment of the present invention shown in FIG. 4 will now be described. In the second embodiment, a spherical transparent plate 3' is interposed between the plates 3 and 4 and the spaces sectioned by this plate 3' are respectively filled with the liquid 5. It is possible to use a plurality of plate 3' to increase the number of sectioned spaces. When the space between the plae 4 and plate 3' alone is filled with the liquid 5, the window will act as a concave lens corresponding to the concaved surface of the plate 3', offering a somewhat reduced views of objects outside the vessel. In case all the spaces sectioned by the plate 3' are filled with the liquid 5, the objects outside the vessel can be observed under the same conditions as in the first embodiment.

The transparent plate 4 receives the water pressure acting on the window and is to be made of reinforced glass or reinforced plastics such as polycarbonate. The transparent plates 3, 3' . . . are the means to seal the liquid 5 and are usually made of plate glass or acrylic plate.

The fluid filled in the space between plates 3 and 4 or between plates 3,3' and 4 preferably contains distilled water, at least 1.5 ppm $Cl_2$ and algaecide such as $CuSO_4$, and its pH is adjusted to be within the range of 7.0–7.16.

The reasons for specifying the above fluid are:

(1) Distilled water contains little bacteria, particularly inorganic inclusions such as calcium carbonate, iron oxide, etc. and other organic inclusions. Thus, the plate surfaces do not become clouded as substances contained in the fluid become adhered thereto or the plate transparency does not deteriorate as the fluid becomes turbid. There are possibilities for such defects unless the distilled water is used.

(2) Commercial bleach powder or liquid, $CaCl_2$, is charged in the distilled water to increase $Cl_2$ content to 1.5 ppm or more. Addition of chlorine will prevent proliferation of bacteria, algae and microorganisms. $Cl_2$ content should be at least 1.5 ppm in order to exert such effects. Even if it is increased to above 2.0 ppm, the effectiveness does not change. Therefore, although it is possible to increase $Cl_2$ content to above 2.0 ppm, the optimum range of $Cl_2$ content is between 1.5 ppm and 2.0 ppm.

(3) For algaecide, $CuSO_4$ which is more effective for preventing algae generation than chlorine is used often. One part of ALGAECIDE available from Texol, US was used for 50,000 parts of water or for 25,000 parts of water. Proliferation of Chlorella Pyrenoidsa Phormidium Imundaun, Lyngba Versicolor was prevented in both cases. Thus, pollution of the fluid by algae was prevented for a long period of time.

(4) Transparency of fluid was maintained by adjusting hydrogen ion concentration index to approximately neutral. In the examples, $H_2SO_4$ dilution was added to the fluid processed with chlorine as in the above, stirred and its pH adjusted to 7.0 to 7.6. With this pH adjustment, the fluid which had turned slightly turbid by addition of bleach powder or liquid became transparent to thereby brighten the vision through the plate.

The underwater windows according to the present invention can be used on any vessel which is intended for underwater inspection or observation, and is particularly suitable for small submarines under visual navigation intended for direct observation in the natural light.

I claim:

1. An underwater window for vessels which is provided to cover an opening made on the hull and comprises a first transparent plate curved to form a convex surface bulging toward the outside of the hull outwardly from the hull and a second transparent plate provided to cover a concave space which is formed on the cabin side by said curved plate, said space formed between the two transparent plates being filled with liquid, wherein the second plate is a substantially flat plate, wherein the liquid contains distilled water, at least 1.5 ppm $Cl_2$ and algaecide such as $CuSO_4$, and its pH is adjusted to within the range of 7.0–7.6.

2. An underwater window for vessels which is provided to cover an opening made on the hull and comprises a first transparent plate curved to form a convex surface bulging toward the outside of the hull outwardly from the hull, a second flat transparent plate provided to cover a concave space which is formed on the cabin side by said curved plate, and a third convex plate having a larger radius of curvature than that of the first plate, the third plate being interposed between the first and second plates, a first space formed between the first and third plates and a second space formed between the second and third plates, both said spaces being filled with liquid.

3. A window as defined in claim 2 wherein the liquid contains distilled water, at least 1.5 ppm $Cl_2$ and algaecide such as $CuSO_4$, and its pH is adjusted to be within the range of 7.0–7.6.

* * * * *